United States Patent [19]

Annovi

[11] 4,095,355

[45] Jun. 20, 1978

[54] SKI BOOT WITH AERATED PADDING OF DIFFERING DEGREES OF SOFTNESS

[75] Inventor: Giuseppe Annovi, Montebelluna, Italy

[73] Assignee: Calzaturificio Giuseppe Garbuio S.A.S., Montebelluna, Italy

[21] Appl. No.: 753,374

[22] Filed: Dec. 22, 1976

[30] Foreign Application Priority Data

Dec. 29, 1975 Italy ..... 62068/75[U]

[51] Int. Cl.[2] ..... A43B 5/04; A43B 19/00

[52] U.S. Cl. ..... 36/118; 36/71

[58] Field of Search ..... 36/11.5, 91, 93, 117, 36/119, 120, 121, 71, 3 R, 3 A, 43, 25 R, 28

[56] References Cited

U.S. PATENT DOCUMENTS

| | | | |
|---|---|---|---|
| 3,685,176 | 8/1972 | Rudy | 36/93 |
| 3,722,113 | 3/1973 | Birkenstock | 36/11.5 |
| 3,750,310 | 8/1973 | Messner et al. | 36/118 |

*Primary Examiner*—Patrick D. Lawson
*Attorney, Agent, or Firm*—D. Paul Weaver

[57] ABSTRACT

An outer rigid ski boot has padding in the form of a soft inshoe therein. The soft inshoe has a surface comprised of a plurality of spaced projections having their tips in contact with the outer rigid upper and/or the skier's foot. The degree of softness of the inshoe is varied by varying the spacing distribution of the projections in the total contact area of the projections with the outer rigid upper and/or the skier's foot.

6 Claims, 2 Drawing Figures

FIG.1
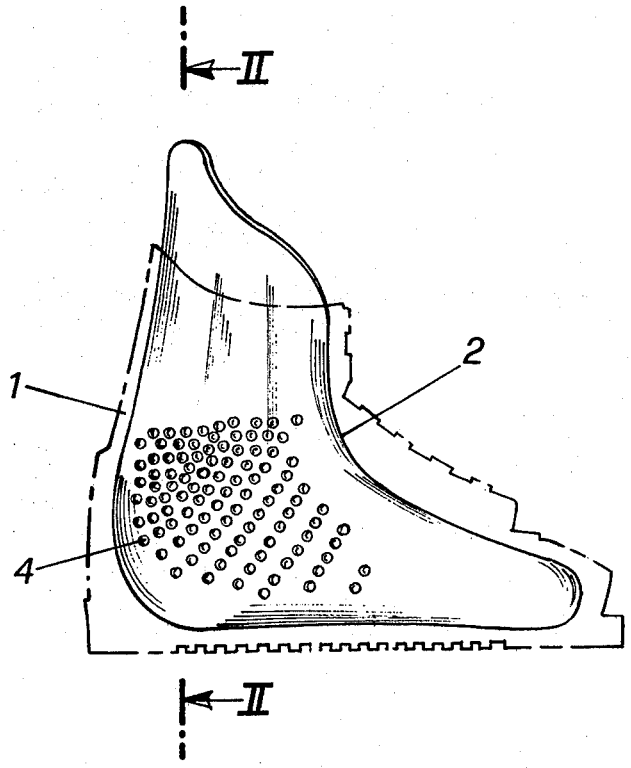
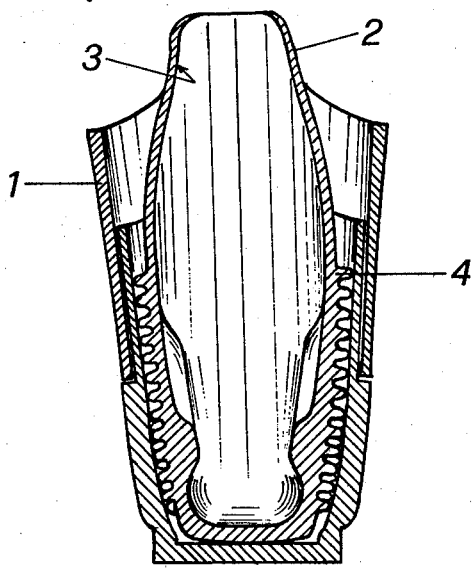
FIG.2

SKI BOOT WITH AERATED PADDING OF DIFFERING DEGREES OF SOFTNESS

BACKGROUND OF THE INVENTION

This invention relates to a ski boot having aerated padding possessing varying degrees of softness over different areas of the foot with the greatest degree of firmness of the padding at the malleoli. More particularly, the invention is embodied in a boot constructed with an outer rigid upper and a soft inshoe possessing the variable softness feature in different areas.

Ski boots are known in the prior art having an outer rigid upper, generally constructed of plastics material, and a soft inshoe, the essential purpose of which is to form a padding for the skier's foot.

In these known boots, the softness of the inshoe is substantially constant over its entire area of contact with the rigid upper and the skier's foot, and this is a disadvantage, in that different regions thereof are subjected to different stresses and/or are required to transmit different forces imparted by the skier to the outer rigid upper, and consequently to the ski.

A further disadvantage is the fact that if the padding completely fills the space between the skier's foot and the outer upper, regular ventilation of the foot is prevented, with consequent discomfort for the skier during use of the boot. Similarly, if this space is not completely filled by the padding, control of the ski is difficult and imprecise.

SUMMARY OF THE INVENTION

By means of the invention, the above disadvantages in the prior art are obviated by a ski boot comprising an outer rigid upper and a soft inshoe housed in the upper, wherein the surface of the soft inshoe in contact with the inner surface of the upper and/or the skier's foot comprises a plurality of projections having their tips in contact with the inner surface of the rigid upper and/or the skier's foot. The spatial distribution of the projections over the contact area serves to vary the degree of softness of the inshoe without the need for varying the density of the material, such as polyurethane foam, used to make the inshoe.

BRIEF DESCRIPTION OF THE DRAWINGS

FIG. 1 is a side elevation of a boot embodying the invention, the outer rigid upper being shown in phantom lines.

FIG. 2 is a vertical section taken on line 2—2 of FIG. 1.

DETAILED DESCRIPTION

Referring to the drawings in detail wherein like numerals designate like parts, it may be seen that the ski boot according to the invention comprises an outer rigid upper 1 constructed, for example, of polyurethane, and an inshoe 2 constructed of polyurethane foam.

The inner surface of the inshoe 2 is lined with cloth 3 which makes contact with the skier's foot comfortable, while the outer surface of the inshoe 2, that is, the surface facing the upper 1, comprises a plurality of hemispherically rounded projections 4 which are most densely distributed or spaced at the malleoli and are more widely spaced or thinned out toward the toes of the skier's foot. The projections 4 are formed during the formation of the soft inshoe 12, and if desired may also be provided on the inner surface of the inshoe in contact with the skier's foot. Because of these projections, proper ventilation of the foot is assured, and the boot may be worn for long periods without discomfort to the skier.

Because of the possibility of varying the distribution of the projections 4 in different regions of the inshoe 2, the degree of softness thereof may be correspondingly varied without changing the density of the constituent polyurethane foam.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A ventilating ski boot with padding having differing degrees of softness at different areas of the foot of the wearer of the boot comprising an outer substantially rigid boot upper, and a soft inshoe housed within the upper and adapted to receive a wearer's foot, a plurality of spaced projections on at least one surface of the soft inshoe between which air may circulate, said projections adapted to have their tips contact an opposing surface within the ski boot, said projections varying in their distribution over the surface of the inshoe to thereby provide differing degrees of softness of the inshoe at certain areas thereof, said projections being most densely distributed adjacent to the malleoli, and said projections having a gradually less dense distribution toward the toe of the boot.

2. A ventilating ski boot with padding having differing degrees of softness at different areas of the foot of a wearer of the boot comprising an outer substantially rigid boot upper, and a soft inshoe housed within the boot upper and adapted to receive a wearer's foot, and a plurality of spaced individually formed pin-like projections on at least one surface of the soft inshoe and having their longitudinal axes substantially normal to said surface, said pin-like projections adapted to have their tips contact an opposing surface within the ski boot.

3. A ventilating ski boot as defined in claim 2, and wherein the tips of said pin-like projections are rounded.

4. A ventilating ski boot as defined in claim 2, and wherein said projections vary in their distribution over the surface of the inshoe to thereby provide differing degrees of softness of the inshoe at certain areas thereof.

5. A ventilating ski boot as defined in claim 4, and wherein said projections are most densely distributed adjacent to the malleoli.

6. A ventilating ski boot as defined in claim 2, and said projections formed on the outer surface of said inshoe and having their tips in contact with the inner surface of the boot upper.

* * * * *